United States Patent [19]

Carlson

[11] Patent Number: 4,953,333

[45] Date of Patent: Sep. 4, 1990

[54] CLEAN ROOM ENCLOSURE

[76] Inventor: Bruce M. Carlson, P.O. Box 33427, St. Paul, Minn. 55133-3427

[21] Appl. No.: 931,615

[22] Filed: Nov. 17, 1986

[51] Int. Cl.[5] ..... E04B 1/00

[52] U.S. Cl. ..... 52/281; 52/79.1; 52/270; 52/288

[58] Field of Search ..... 52/281, 584, 395, 79.1, 52/270, 238.1, 288

[56] References Cited

U.S. PATENT DOCUMENTS

| | | | |
|---|---|---|---|
| 3,052,330 | 9/1962 | Hammitt et al. | 52/395 X |
| 3,457,698 | 7/1969 | Albers | 52/270 X |
| 3,530,633 | 9/1970 | Scott | 52/584 X |
| 3,975,995 | 8/1976 | Shuler | 98/40 D |
| 4,063,393 | 12/1977 | Toti | 52/281 X |
| 4,594,278 | 6/1986 | Nixon | 428/68 |
| 4,603,618 | 8/1986 | Charles | 98/31.5 |
| 4,608,066 | 8/1986 | Cadwell, Jr. | 55/385 A |

*Primary Examiner*—Carl D. Friedman

*Attorney, Agent, or Firm*—Gerald F. Chernivec

[57] ABSTRACT

A clean room enclosure comprising wall panels joined together by trim members to support studs, the studs and trim members being slotted to contain a plurality of flexible sealing members therein and means to operatively attach the trim members to the studs in a manner that all sealing members are engaged to prevent passage of air therethrough.

10 Claims, 4 Drawing Sheets

CLEAN ROOM ENCLOSURE

TECHNICAL FIELD

This invention pertains to a clean room enclosure, and more particularly to an enclosure having a ceiling and side walls which are effectively sealed to the passage of air therethrough.

BACKGROUND ART

The clean room industry was spawned in the early 1960's. The advent of high tech developments in electronics, optics, telecommunications, robotics, medicine, and genetic engineering, to name a few, gave rise to an ever growing need for "clean space" in manufacturing, research and development.

Typically, clean rooms are based on the concept of providing clean air, uncontaminated, to the clean room. The contamination level of clean air is generally proportional to the number of filtered air changes per hour caused to move through an enclosed space. The higher the filtered air exchange rate, the cleaner the room. Thus, the major effort relative to clean rooms has been typically related to the concept of supplying an optimum number of air changes per hour, wherein the air changes contain a minimum of particulate matter of a minimum size.

In addition, filtering mechanisms have been in the forefront of patent literature. For example, it has been found that turbulent distribution of air requires a greater number of air changes to achieve a given level of efficiency. Accordingly, a great deal of patent literature deals with the concept of reducing turbulent distribution to laminar distribution, such distribution being based on the filtration mechanisms desired.

For example, U.S. Pat. No. 3,975,995 discloses a specially constructed ventilated ceiling construction to assertedly provide laminar air flow. U.S. Pat. No. 4,603,618 again deals with ceiling ventilation construction to maximize laminar air flow.

U.S. Pat. No. 4,608,066 discloses providing a wall panel clean room construction that allows for walls to be movably positioned so as to divide a clean room into separated work areas.

U.S. Pat. No. 4,594,278 discloses acoustical panels designed to reduce the noise level in clean rooms.

However, there has been very little, if any, patent literature dealing with the concept of ceiling and/or wall design of clean rooms, i.e., designs to minimize the loss of air through ceiling and wall panels.

Accordingly, the present invention is directed to such a wall and ceiling design.

SUMMARY OF THE INVENTION

In accordance with the invention, there is provided a clean room enclosure comprising a ceiling and side walls, the side walls comprising side wall panels fixedly attached to support studs such that at least a portion of the studs are exposed to the room, the studs having a plurality of slots in the exposed surface thereof disposed adjacent the side wall panels, these slots containing flexible sealing members therein. In addition, a vertical trim members are provided over the exposed surfaces of the support studs, these members comprising a flat plate having extended inwardly from at least the outboard edges thereof slotted members containing flexible sealing members therein. In addition, there are provided means for operatively attaching these vertical trim members to the studs in such a manner that all sealing members are engaged so as to effectively prevent the passage of air therethrough.

DETAILED DESCRIPTION

Figure 1:
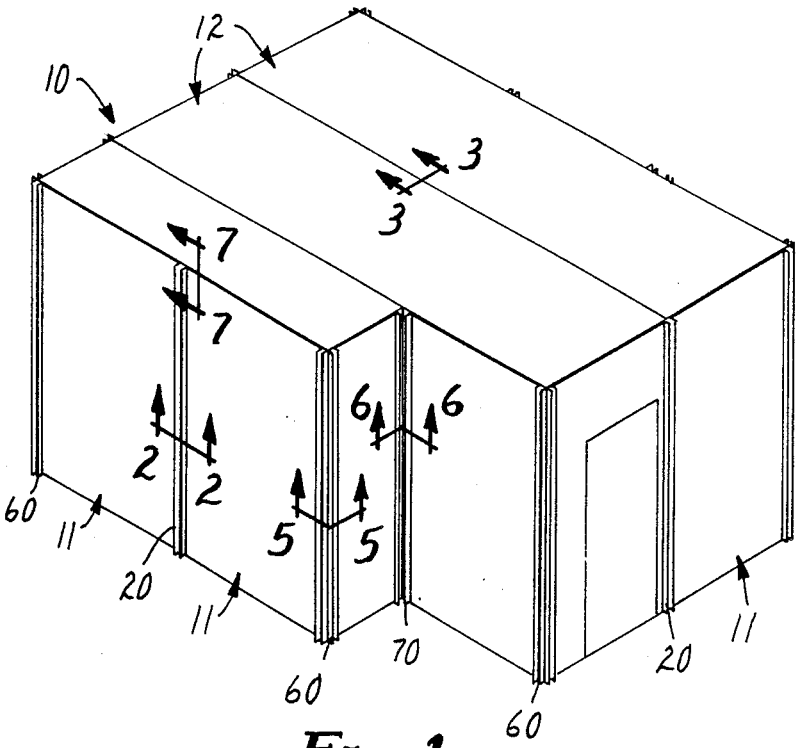
FIG. 1 is a perspective view of a clean room embodying the features of the present invention.

Referring more particularly to the drawings, FIG. 1 is a perspective view of a clean room 10 embodying the features of the present invention, and containing wall panels 11 and ceiling panels 12.

Figure 2:
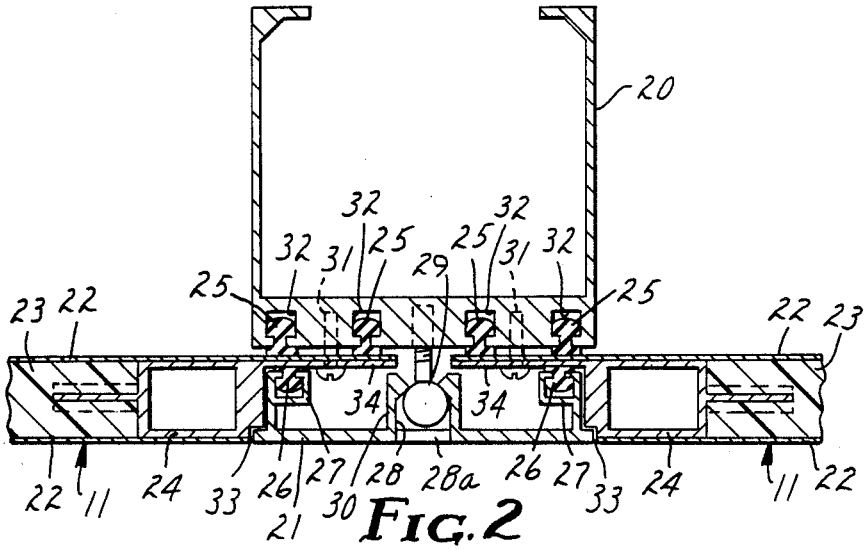
FIG. 2 is a sectional view taken substantially along the lines 2—2 of FIG. 1, and illustrating the means for attaching wall panels to support studs.

FIG. 2 illustrates wall panels 11 fixedly attached to support stud 20 with the appropriate sealing mechanisms of the invention to prevent the passage of air therethrough. Wall panel 11 should be substantially impervious itself to the passage of air. As illustrated, a preferred construction comprises metallic skin 22, preferably aluminum, contained on both the inner and outer surfaces of wall panel 11 with a lightweight resinous core material, such as noryl or polypropylene 23 inserted therebetween. Each wall panel 11 preferably contains a panel edge frame member 24 to provide rigidity to the panel edges. In addition, edge frame member 24 also preferably has integrally attached elongate vertical plate member 34, which will allow fixed attachment of panel 11 to stud 20 through the use of bolts 31. In the area of stud 20 adjacent the wall panels are contained slots 32 which contain flexible sealing members 25 therein. Panel edge frame members 24 also preferably contain slot 33 therein, designed to allow for a totally flush attachment of vertical trim member 21 upon application of same. Trim member 21 comprises a substantially flat plate having integrally attached to the ends thereof and extending inwardly, slots 27 containing flexible sealing members 26 therein. To allow attachment to stud 20, trim member 21 preferably contains channel 30 having tapered ends so as to allow engagement and retention of bolt 29, which is threadedly attached to stud 20. Opening 28 in trim member 21 allows access to bolt 29 to thus provide operative engagement between the various sealing members 25 and 26 by causing trim member 21 to be moved inwardly against the flexible sealing members. This ensures a complete seal of the egress of air through the panel attachment. For convenience sake, and to ensure a totally flat surface, and thus avoid the possibility of contaminant build-up thereon, threaded plug 28a is illustrated as being placed into hole 28 in vertical trim member 21.

Figure 3:
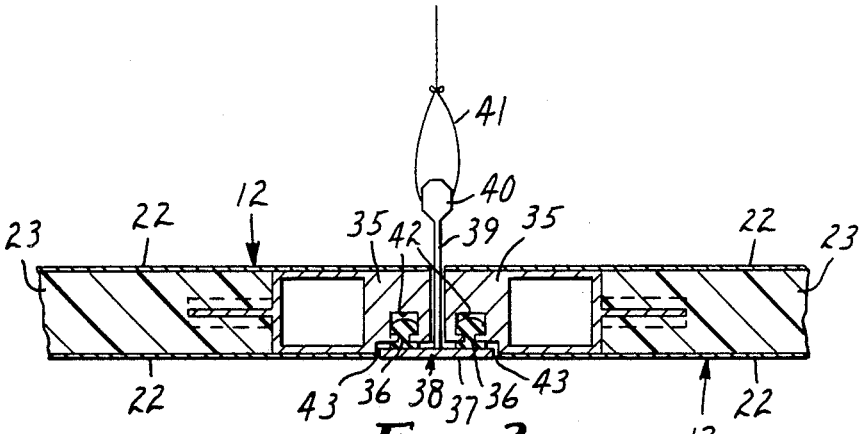
FIG. 3 is a sectional view taken along the lines 3—3 of FIG. 1 and illustrating a ceiling panel construction.
Figure 4:
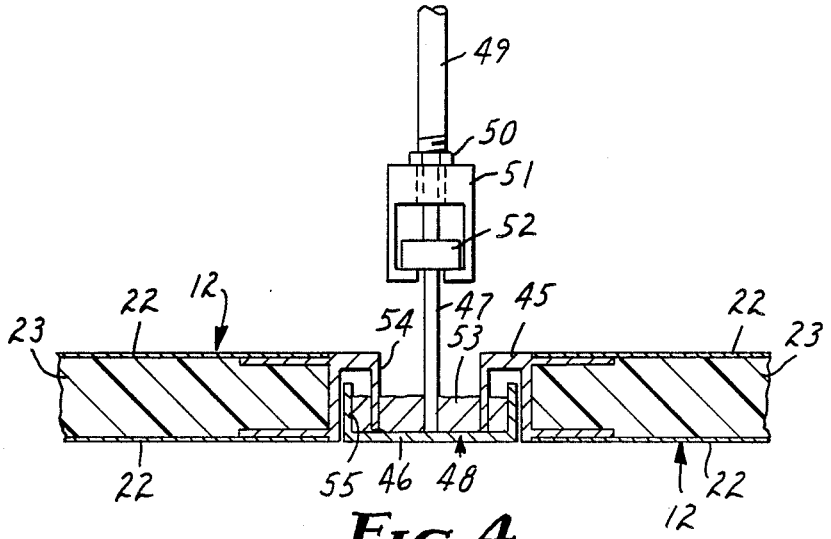
FIG. 4 is an alternative embodiment of the ceiling panel construction generally taken along the section lines 3—3.

FIGS. 3 and 4 illustrate alternative embodiments for ceiling panel attachment and support. In FIG. 3, ceiling panel 12 preferably contains an edge frame member 35 having a slot 42 disposed adjacent the clean room enclosure, slot 42 containing therein a flexible sealing member 36. In addition, edge frame member 35 also preferably is slotted to provide a flush surface with support member 38, as illustrated at 43 of FIG. 3. Support member 38 is an inverted "T", and the weight of ceiling panel 12 itself causes sealing members 36 to become engaged with plate 37 to prevent air flow between ceiling panel sections. Inverted "T" 38 further contains elongate leg 39 which can be attached, as illustrated at 40, to a tie rod or wire support member 41.

In FIG. 4, ceiling panels 12 contain an edge frame member 45 having an inverted peripheral skirt 54 adapted to rest on ceiling support member 48, which itself has an extended peripheral skirt 55 which is adapted to contain a fluid sealant 53 such that an air tight seal is formed therebetween. As illustrated, support rod 47 is fixedly connected to support member 48 and has an adjustable member 52 which is supported by retaining ring 51 on tie rod or hanger bar 49. Nut 50 can be utilized to fix the position of tie rod 49 after final placement of the ceiling panels.

Figure 5:
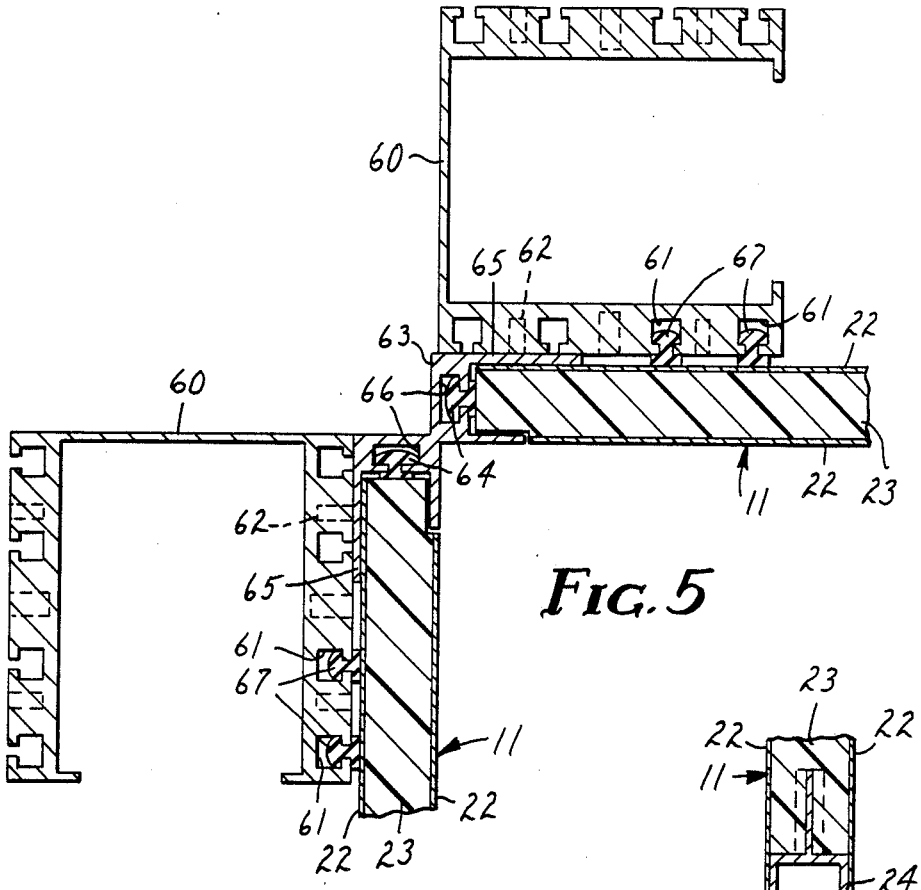
FIG. 5 is a sectional view taken along lines 5—5 of FIG. 1, and illustrating an inside corner construction of the clean room of my invention.

FIG. 5 illustrates an inside corner of the clean room of my invention, wherein trim member 63 has smooth vertical members at right angles to each other and facing slots 66 containing sealing members 64 therein. These sealing members are in direct contact with wall panels 11, and can be fixedly attached via plates 65 to support studs 60 via bolts 62. Support studs 60 contain slots 61 with flexible sealing members 67 therein to provide a multiple of sealing engagements.

Figure 6:
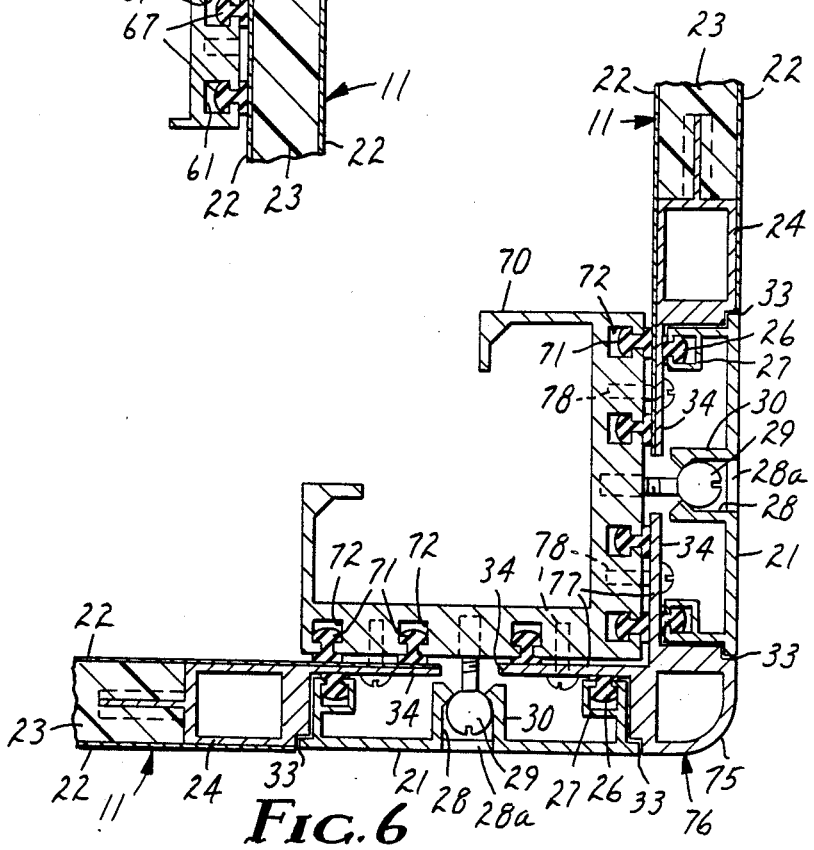
FIG. 6 is a sectional view taken along lines 6—6 of FIG. 1, and illustrating an outside corner of the clean room of my invention.

FIG. 6 illustrates an outside corner based on the same principles as earlier enunciated, with the exception that support stud 70 in this instance contains slots 72 on both faces which abut panel sections 11. Slots 72 contain flexible sealing members 71 therein which function as previously discussed. In this instance, vertical corner trim member 76 can be utilized, containing elongate plates 77 which can assist in attachment to stud 70 via bolts 78. Exterior trim members 21 are utilized as discussed in FIG. 2.

Figure 7:
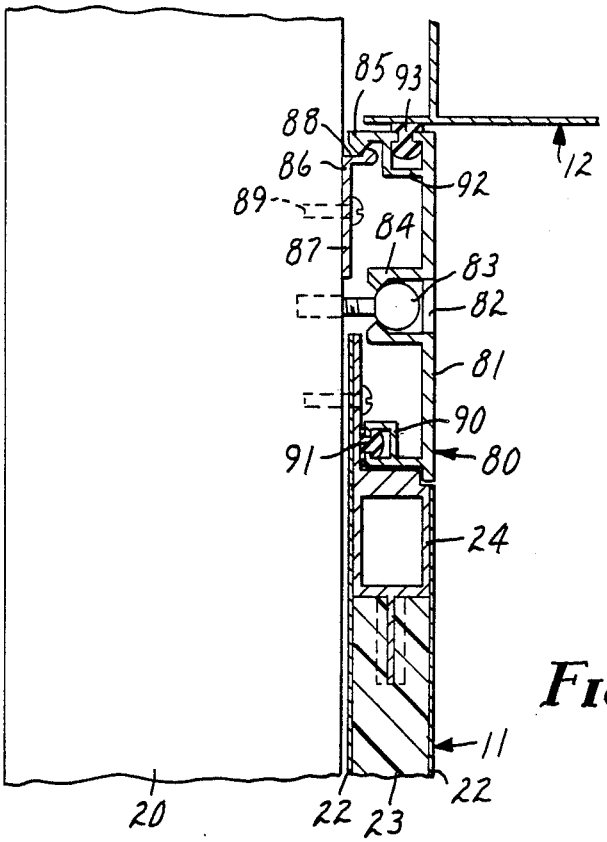
FIG. 7 is a sectional view taken along lines 7—7 of FIG. 1 and illustrating the wall panels sealingly attached to the ceiling panel sections of the clean room of the invention.

FIG. 7 illustrates a panel section having a horizontal trim member 80 for attachment to ceiling panels 12. In this instance, again, the panel preferably has an edge frame member 24 utilized as before, but in this case trim member 80 is comprised of face plate 81 having attached thereto at the wall panel outboard edge slot 90 containing flexible sealing member 91 therein, which functions as earlier discussed. At the other outboard end of horizontal trim member 80, however, slot 92 is disposed upwardly towards ceiling panel 12, and contains flexible sealing member 93 therein, again designed to eliminate air flow at the junction of wall and ceiling. Extending inwardly from slot 92 is lip 85 which can rest for support on support member 86, which consists of flat plate 87 containing horizontal lip 88 thereon designed to interact for support with lip 85 on wall panel 11, and which is fixedly attached to stud 20 by bolt 89.

Figure 8:
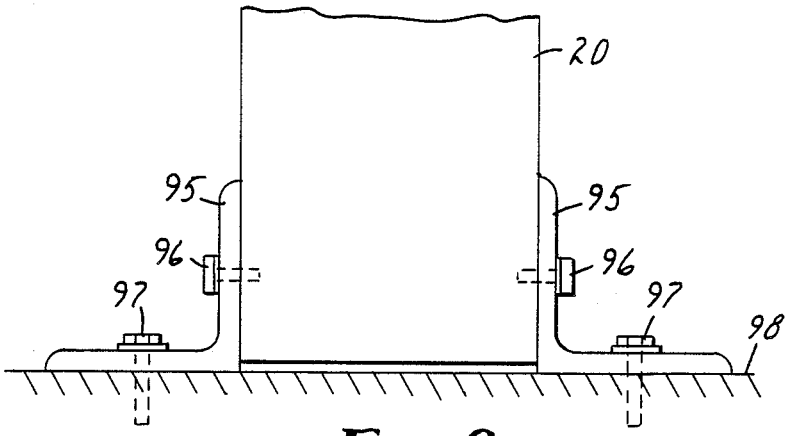
FIG. 8 illustrates attachment of the support studs of the clean room fixedly to a floor member.

FIG. 8 illustrates a method for attachment to the floor of a clean room, which simply consists of angle members 95 fixedly attached via bolts 96 to stud 20 and via bolts 97 to floor 98.

In the drawings and specification, there has been set forth preferred embodiments of the invention, and while specific terms are employed, they are used in a generic and descriptive sense only and are not for purposes of limitation.

What is claimed is:

1. A clean room enclosure comprising a ceiling and side walls, said side walls comprising side wall panels fixedly attached to support studs such that at least a portion of said studs are exposed to said enclosure; said studs having a plurality of slots in the exposed surface thereof and disposed adjacent said panels, said slots containing flexible sealing members therein; a vertical trim member displaced over said exposed surfaces of said studs, said trim member comprising a flat plate having extended inwardly from at least the outboard edges thereof slotted members containing flexible sealing members therein; and, means for operatively attaching said trim member to said studs in a manner such that all sealing members effectively prevent passage of air therethrough, wherein said means for operatively attaching said trim members to said studs comprises substantially parallel channel members integral with said trim member and extending inwardly from said flat plate toward said stud, the ends of said channel members being tapered inwardly, and a threaded member threadedly attached to said support stud, the head of said threaded member being engaged by said ends of said channel members, such that said threaded member can rotatable increase the sealing force of said sealing members.

2. The enclosures of claim 1 wherein said panels contain panel edge frame members for fixedly attaching said panels to said support studs.

3. The enclosure of claim 1 wherein said flat plate contains holes therein over said threaded member to allow engagement to said head of said threaded member from inside said enclosure by means capable of rotating said threaded member.

4. The enclosure of claim 3 wherein said holes are threaded and contain a removable cap threadedly engaged therewith.

5. The enclosure of claim 1 wherein inside corners defined by said side wall panels are joined together by an inside corner trim member comprising integral plates extending at right angles and containing on their opposing surfaces slots containing flexible sealing members therein adapted to seal against said side wall panels and prevent the flow of air therethrough.

6. The enclosure of claim 1 wherein outside corners defined by said side wall panels are joined by an outside corner trim member capable of fixedly and sealingly attaching said vertical trim members to said support studs.

7. The enclosure of claim 1 wherein said panels comprise at least one surface which is impervious to the passage of air therethrough.

8. The enclosure of claim 1 wherein said panels comprise an air-impervious metallic inner and outer surface and a plastic core therebetween.

9. The enclosure of claim 8 wherein said metallic surface is aluminum.

10. The enclosure of claim 1 wherein said support studs and said vertical trim members comprise extruded aluminum.

* * * * *